US005803009A

United States Patent [19]

Audoly

[11] Patent Number: 5,803,009

[45] **Date of Patent: *Sep. 8, 1998**

[54] PROCESS OF PROTECTING AN OBJECT FROM SOUND WAVES

[75] Inventor: Christian Audoly, Six Fours, France

[73] Assignee: Delegation Generale pour l'Armement, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 638,579

[22] Filed: Apr. 29, 1996

[30] Foreign Application Priority Data

Apr. 27, 1995 [FR] France ..... 95 05050

[51] Int. Cl.[6] ..... B63G 8/28

[52] U.S. Cl. ..... 114/312; 181/286; 114/357

[58] Field of Search ..... 114/312, 357, 114/270, 65 R, 355; 181/286, 294; 427/409, 407.1

[56] References Cited

U.S. PATENT DOCUMENTS

| | | | |
|---|---|---|---|
| 2,881,336 | 4/1959 | Elion . | |
| 3,515,910 | 6/1970 | Fritz et al. . | |
| 4,883,143 | 11/1989 | Lagier | 181/286 |
| 5,613,460 | 3/1997 | Stallard, III | 114/312 |

FOREIGN PATENT DOCUMENTS

| | | | |
|---|---|---|---|
| A-0 317 380 | 5/1989 | European Pat. Off. . | |
| A-2 234 627 | 6/1974 | France . | |
| A-2 656 718 | 7/1991 | France . | |
| A-2 664 868 | 1/1992 | France . | |
| A-132 813 | 10/1971 | Netherlands . | |
| 2146295 | 4/1985 | United Kingdom | 114/312 |

*Primary Examiner*—Ed L. Swinehart

*Attorney, Agent, or Firm*—Oliff & Berridge, PLC

[57] ABSTRACT

A method of providing protection to a substrate or an object near a substrate includes placing a material between the substrate or object and a source of sound waves, the material being a viscoelastic matrix reinforced with rods or fibrous materials. The method is particularly useful when the substrate is an underwater craft or when the object to be protected is a sonar antenna.

8 Claims, 3 Drawing Sheets

PROCESS OF PROTECTING AN OBJECT FROM SOUND WAVES

BACKGROUND OF THE INVENTION

The invention relates to a material for absorbing sound waves and reducing sound echo when placed on a structure excited by an exterior sound wave, particularly for submarine applications.

An acoustic material is characterized by input impedance whose value is the density of the material multiplied by the speed of sound.

The efficiency of an acoustic material absorbing sound waves is evaluated by its reflection coefficient, which has to be as low as possible and which is defined as the ratio between reflected pressure and incident pressure when a layer of such a material is placed on an immovable support.

In fact, the acoustic properties of a material are characterized by three parameters: density of the material, complex longitudinal speed of the sound waves with the formula $C_L=C'_L(1+i\eta_L)$, and transverse speed of the acoustic waves with formula $C_T=C'_T(1+i\eta_T)$, where $C'_L$ and $C'_T$ represent the respective real parts of $C_L$ and $C_T$ and where $\eta_L$ and $\eta_T$ represent the respective attenuations of $C_L$ and $C_T$.

Materials that allow sound waves to be strongly attenuated must on the one hand have a high longitudinal speed attenuation $\eta_L$ and on the other hand have the real part of longitudinal speed $C'_L$ and density which are both close to those of seawater for submarine applications.

Coatings are known that absorb sound waves and consist of an elastomer matrix in which air microinclusions, possibly minerals as well, are randomly dispersed. In this type of material, the unattenuated longitudinal waves are converted into attenuated transverse waves which dissipate energy and confer anechoic properties on the material.

Alveolar materials known as "Alberich type" are known which have an elastomer layer in which air cavities are molded. The choice of the elastomer and the size of the cavities depends on the frequency band chosen.

These two types of coatings usable in submarine acoustics have two drawbacks; their acoustic performance depends strongly on immersion, and their fairly high volume compressibility under hydrostatic pressure makes it difficult to build a large quantity of material into the hull of an underwater craft.

French Patent FR 2,656,718 describes acoustic absorbers designed to be immersed in the sea, comprised of beehive structures that rest at one end on a support to which they are attached and whose other end, closed by a membrane, is in contact with the incident acoustic wave. The interiors of the cells of the beehives are filled with a viscoelastic fluid which allows the acoustic energy to be absorbed by mechanical dissipation. This absorber is largely insensitive to immersion pressure but it is not easy to build into the hull of a submarine craft due to the presence of rigid cells filled with fluid.

SUMMARY OF THE INVENTION

A goal of the invention is to propose a device for absorbing sound waves in submarine acoustics, not sensitive to immersion pressure, and easily buildable into the hull of a submarine craft.

The invention relates to a material for absorbing sound waves that has a viscoelastic matrix in which rod-like reinforcements are distributed.

Contrary to the materials commonly used, the material according to the present invention contains no water and its acoustic properties are independent of hydrostatic pressure.

Due to the presence of rod-like reinforcements, its static compressibility coefficient is low. Building the material onto submarine vehicles is easy and it is not necessary to compensate the change in volume of the material by immersion using ballast.

The reinforcements can be randomly or periodically distributed within the viscoelastic matrix.

The reinforcements are preferably rods made of metal.

Other characteristics will emerge from reading the description hereinbelow of a nonlimiting preferred embodiment provided for illustration and the attached figures.

DESCRIPTION OF A PREFERRED EMBODIMENT

Figure 1:
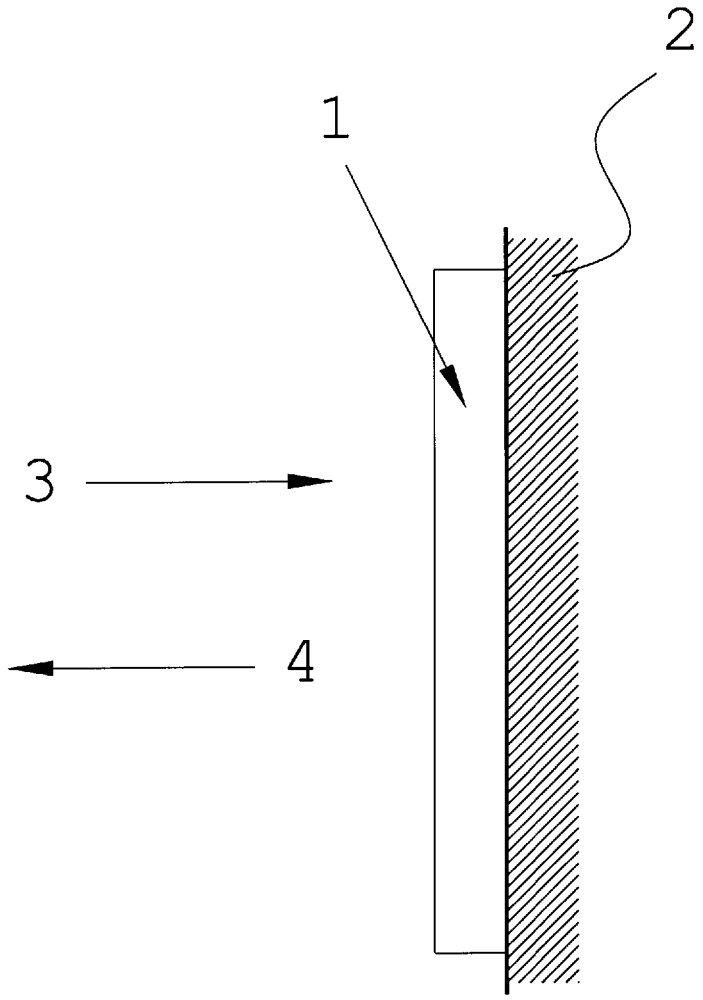
FIG. 1 represents a panel formed of a material absorbing sound waves placed on a rigid support.

In FIG. 1, the material according to the present invention is placed in the form of a panel 1 on a rigid support 2. It allows the amplitude of the reflected sound wave 4 to be reduced when the support coated with a material according to the present invention is subjected to an incident sound wave 3.

The panel 1 is preferably attached to rigid support 2 using adhesive bonding; however, other means, such as mechanical fasteners, may be used to attach panel 1 to rigid support 2 provided that the attachment means do not substantially disturb the acoustical properties of the panel.

Figure 2:
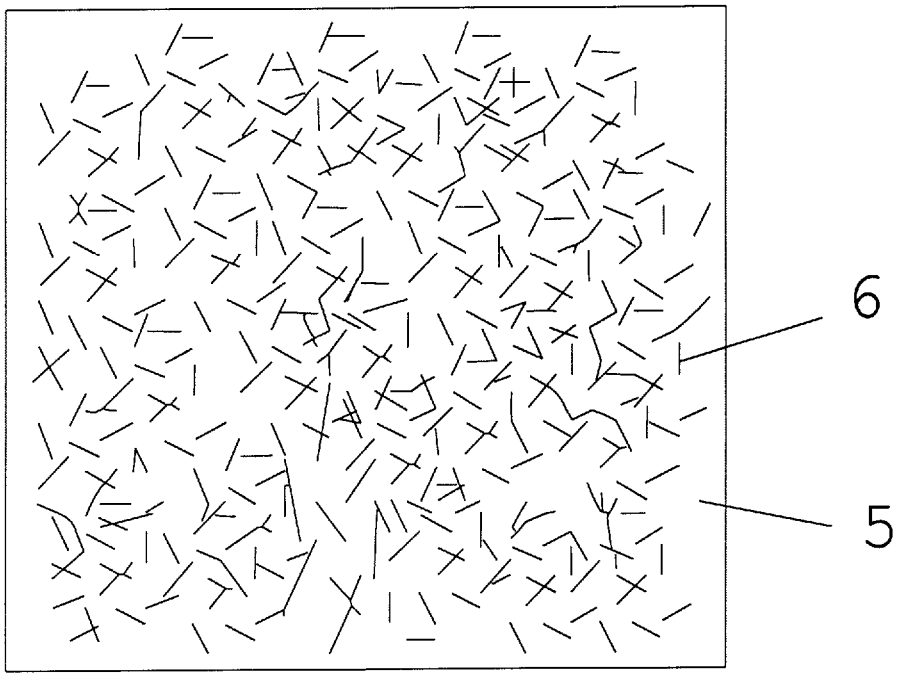
FIG. 2 represents a frontal view of a panel according to a first embodiment of the invention.

FIGS. 2 shows panel 1 comprising a matrix of viscoelastic material 5, wherein reinforcements 6 are randomly distributed. Preferably, the reinforcements are placed with their axes parallel to the plane defined by the faces of the panel.

Suitable matrix materials include viscoelastic materials having high damping characteristics in the frequency and temperature range of interest given a particular application. Preferably, the matrix material is a curable elastomer such as polyurethane.

Suitable rod-like reinforcements include metal rods, mineral fibers and synthetic fibers. Preferably, the metal rods are made of steel. Suitable mineral and synthetic fibers have a stiffness higher than that of the matrix material and comprise a material which is not fragile.

Reinforcements may have a wide range of dimensions. Typically, reinforcements have a diameter range of about 1 mm to about 5 mm and a length range of about 10 mm to 50 mm. The choice of reinforcement dimensions will depend on the matrix characteristics and the frequency range of interest given a particular application.

Volume percent of reinforcements in the matrix material may vary considerably; however, a typical reinforcement volume percent is about 5 to 20% of the total panel volume.

Panel thickness will vary depending on a particular application. Typically, panel thickness will vary from about 30 mm to 100 mm.

Integration of rod-like reinforcements stiffens the viscoelastic material laterally, which modifies its dynamic properties and allows the longitudinal sound waves to be converted into transverse waves. The attenuation coefficient of the longitudinal waves is significantly increased thereby.

A preferred panel, according to the present invention, is made by casting a layer of viscoelastic material such as a polyurethane resin, Hexcel UR 267, about 40 mm thick, with lateral dimensions of about 900 mm×900 mm, on steel rods 20 mm long and 2 mm in diameter, to minimize the number of trapped air bubbles. The rod volume of this particular panel represents 7.3% of the total panel volume.

Such a panel has a reflection coefficient of approximately −15 decibels at atmospheric pressure and approximately −10 decibels at 40 bars or at an immersion depth of 400 meters, starting at 20 kHz. These same performances are obtained for frequencies lower than 20 kHz with a layer of material greater than 50 mm in thickness.

Figure 3:
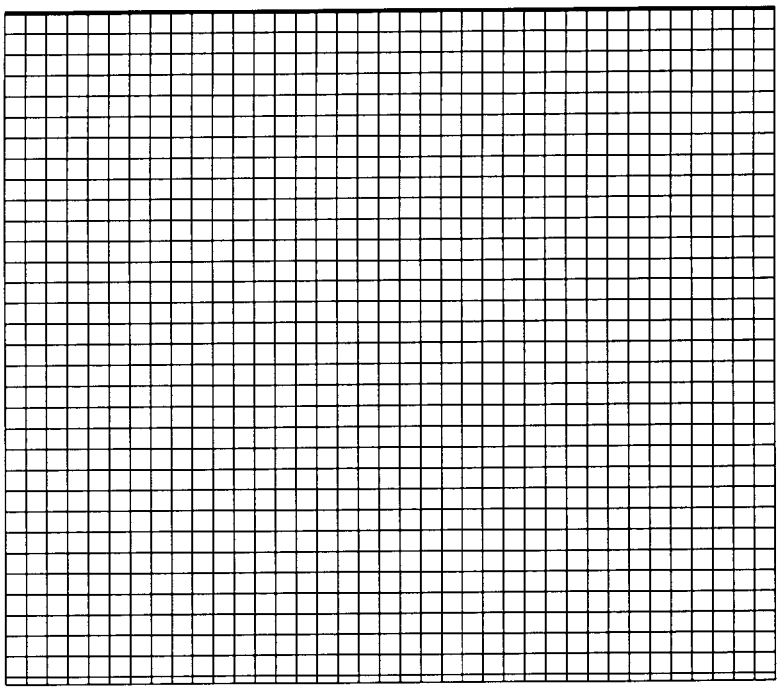
FIG. 3 represents a frontal view of a panel according to a second embodiment of the invention.

In another embodiment shown in FIG. 3, the rod-like reinforcements are distributed periodically and form a network within the matrix material.

In an alternative embodiment, the metal rods can be replaced by mineral or synthetic fibers described above.

A material according to the present invention can be placed on any surface for protection of the surface or an object near the surface from approaching sound waves. For example, the material of the present invention can be placed on surfaces near a sonar antenna to decrease parasitic echoes. In the same way, it protects the sonar antenna from noise interference from the ship carrying it. Other suitable applications will be apparent from the above disclosure.

What is claimed is:

1. A coating material in contact with ambient fluid and having improved sound wave absorbing and sound echo reducing properties for use on a substrate which is excitable by an exterior sound wave, said coating material comprising a viscoelastic matrix material and at least one reinforcement selected from the group consisting of rods, mineral fibers and synthetic fibers embedded in the viscoelastic matrix material, said matrix material not containing air or gas inclusions and selected such that its static compressibility is close to that of water, thus providing to said coating material acoustic performance independent of water depth, when immersed.

2. The coating material of claim 1, wherein the substrate is a submarine hull.

3. The coating material of claim 1, wherein the viscoelastic matrix material comprises polyurethane.

4. The coating material of claim 1, wherein the at least one reinforcement comprises rods.

5. The coating material of claim 4, wherein the rods comprise steel rods.

6. The coating material of claim 5, wherein the steel rods are from about 10 mm to about 50 mm in length and from about 1 mm to about 5 mm in diameter.

7. The coating material of claim 1, wherein the at least one reinforcement is randomly distributed throughout the matrix materials.

8. A coating material for use on a substrate which is excitable by an exterior sound wave, said coating material comprising a viscoelastic matrix material and at least one reinforcement selected from the group consisting of rods, mineral fibers and synthetic fibers, wherein the at least one reinforcement is randomly distributed throughout the matrix material.

* * * * *